US008858252B2

(12) United States Patent
Ijima

(10) Patent No.: US 8,858,252 B2
(45) Date of Patent: Oct. 14, 2014

(54) RECEPTACLE CONNECTOR

(76) Inventor: Norihumi Ijima, Kawasaki (JP)

( * ) Notice: Subject to any disclaimer, the term of this patent is extended or adjusted under 35 U.S.C. 154(b) by 80 days.

(21) Appl. No.: 13/583,454

(22) PCT Filed: Apr. 2, 2011

(86) PCT No.: PCT/JP2011/058466

§ 371 (c)(1),
(2), (4) Date: Dec. 20, 2012

(87) PCT Pub. No.: WO2011/125955

PCT Pub. Date: Oct. 13, 2011

(65) Prior Publication Data

US 2013/0102182 A1 Apr. 25, 2013

(30) Foreign Application Priority Data

Apr. 2, 2010 (JP) ..... 2010-086561

(51) Int. Cl.
*H01R 13/625* (2006.01)
*H01R 13/627* (2006.01)
*H01R 13/639* (2006.01)
*H01R 13/635* (2006.01)

(52) U.S. Cl.
CPC ..... *H01R 13/639* (2013.01); *H01R 13/6276* (2013.01); *H01R 13/635* (2013.01)
USPC ..... 439/348; 439/319

(58) Field of Classification Search
CPC ..... H01R 13/623; H01R 13/625; H01R 13/6275; H01R 13/6276; H01R 13/635; H01R 13/639; H01R 39/643
USPC ..... 439/258, 319, 345–348, 350, 352
See application file for complete search history.

(56) References Cited

U.S. PATENT DOCUMENTS

| | | | | |
|---|---|---|---|---|
| 5,368,499 | A * | 11/1994 | Hirt | 439/350 |
| 6,062,891 | A * | 5/2000 | Villiers | 439/348 |
| 6,773,292 | B2 * | 8/2004 | Fawcett | 439/348 |
| 6,893,284 | B1 * | 5/2005 | Fawcett et al. | 439/348 |
| 7,357,659 | B2 * | 4/2008 | Yoshimori et al. | 439/348 |
| 7,699,640 | B2 * | 4/2010 | Brekosky et al. | 439/350 |
| 8,435,061 | B2 * | 5/2013 | Ijima | 439/348 |

FOREIGN PATENT DOCUMENTS

| | | |
|---|---|---|
| JP | 09-055257 | 2/1997 |
| JP | 2001-068210 | 3/2001 |
| JP | 2003-031306 | 1/2003 |
| JP | 2009-272261 | 11/2009 |
| JP | 2009-272261 A | 11/2009 |
| WO | WO 90/15282 A1 | 12/1990 |

OTHER PUBLICATIONS

Supplemental European Search Report dated Apr. 17, 2014 (7 pages).

* cited by examiner

*Primary Examiner* — Thanh Tam Le
(74) *Attorney, Agent, or Firm* — Flynn, Thiel, Boutell & Tanis, P.C.

(57) ABSTRACT

A receptacle connector 10 has a first holding mechanism 17 for holding a plug 50 connected to a holder 12 by fitting a ball 16 disposed in a hole 12D defined in the holder 12 into a hole 52A defined in a second shell 52 of the plug 50 through a recess 11E defined in the outer circumferential surface of a first body 11, and a second holding mechanism 18 for coacting with the first holding mechanism 17 to keep the plug 50 and the holder connectable to and releasable from each other.

5 Claims, 9 Drawing Sheets

(a)

(b)

(c)

(a)

(b)

(a)

(b)

(a)

(b)

RECEPTACLE CONNECTOR

TECHNICAL FIELD

The present invention relates to a receptacle connector for connecting to devices for sending and receiving audio and video signals, and more particularly to a receptacle connector which allows a plug to be easily connected thereto and removed therefrom.

BACKGROUND ART

Heretofore, a receptacle connector shown in FIG. 9 of the accompanying drawings, which is of the type described above, has been in widespread use in the art. The receptacle connector will be described below with reference to FIG. 9. As shown in FIG. 9, the receptacle connector according to the background art, denoted by 1, is used as being fixed to a panel 2 of a device for sending and receiving audio and video signals. Communication cables 3A, 3B for audio and video signals are connected to each other by inserting a plug 4 into the receptacle connector 1. When the plug 4 is inserted into the receptacle connector 1, a lock mechanism (not shown) is actuated to keep the receptacle connector 1 and the plug 4 connected for thereby locking the plug 4 against removal from the receptacle connector 1.

For removing the plug 4 from the receptacle connector 1, the user pushes a lever 1A with one hand to release the lock mechanism, and then grips the plug 4 with the other hand and pulls the plug 4 from the receptacle connector 1.

DISCLOSURE OF THE INVENTION

Problems to be Solved by the Invention

Since the user needs to push the lever 1A with one hand to release the lock mechanism and then pull the plug 4 from the receptacle connector 1 with the other hand, the user has to operate the lever 1A of the receptacle connector 1 each time the user connects the plug 4 to the receptacle connector 1 and pulls the plug 4 from the receptacle connector 1.

The present invention has been made in view of the above problems. It is an object of the present invention to provide a receptacle connector which allows a plug to be easily connected thereto and removed therefrom, and which securely prevents the plug from being dislodged from the receptacle connector.

Means for Solving the Problems

In accordance with (1) of the present invention, a receptacle connector includes a first body having a pin hole for inserting therein a pin of a plug for electrical connection thereto, a tubular holder having a thinner portion disposed on a proximal end side thereof and a thicker portion disposed on a distal end side portion thereof with a step interposed therebetween, the tubular holder being slidable along the first body, a tubular first shell having an end fixed to a large-diameter portion on a proximal end of the first body and another end extending to a distal end of the holder, a helical spring resiliently disposed between the large-diameter portion and the proximal end of the holder, a stop ring for preventing the holder biased by the helical spring from being dislodged from the first body, a first holding mechanism for holding the plug connected to the holder by fitting a ball disposed in a hole defined in the holder into a hole defined in a second shell of the plug through a recess defined in an outer circumferential surface of the first body, and a second holding mechanism for coacting with the first holding mechanism to keep the plug and the holder connectable to and releasable from each other, wherein when the plug is pushed in between the holder and the first shell against the bias of the helical spring, the first holding mechanism is actuated to fix the plug to the holder and the second holding mechanism holds the plug and the holder connected to each other, and when the plug is pushed in against the bias of the helical spring while the plug and the holder are connected to each other, the second holding mechanism releases the plug and the holder from each other and the first holding mechanism is actuated to release the plug and the holder from each other, the second holding mechanism including a plurality of radially outward fingers projecting radially outwardly from a circumferential surface of the thicker portion of the step of the holder and circumferentially spaced at equal intervals, a plurality of first engaging teeth projecting from the step of the thicker portion of the holder toward the proximal end and circumferentially spaced at equal intervals, the first engaging teeth being circumferentially displaced from the radially outward fingers by a predetermined angle, a first ring rotatably disposed between the large-diameter portion of the first body and the first engaging teeth of the holder and having a plurality of second engaging teeth engaging circumferentially slanted surfaces of the first engaging teeth, and a bushing positioned on an inner circumferential surface of the first shell between the first and second engaging teeth and having third engaging teeth for engaging circumferentially slanted surfaces of the second engaging teeth to rotate the first ring circumferentially, wherein the bushing has a plurality of cavities defined in an inner circumferential surface thereof for passing therein the radially outward fingers and fitting grooves defined in the inner circumferential surface thereof for allowing the second engaging teeth to move into and out of the fitting grooves.

In accordance with (2) of the present invention, in a receptacle connector according to (1), the third engaging teeth of the bushing has slanted surfaces circumferentially longer than the slanted surfaces of the second engaging teeth of the first ring, and engaging portions disposed on respective extension ends of the slanted surfaces for stopping the first ring against rotation.

In accordance with (3) of the present invention, in a receptacle connector according to (1) or (2), the first engaging teeth have a width representing the sum of the widths of at least the radially outward fingers and the second engaging teeth disposed inwardly of the radially outward fingers.

In accordance with (4) of the present invention, in a receptacle connector according to (2) or (3), the engaging portions of the third engaging teeth have, on projecting ends thereof, slanted surfaces for guiding the second engaging teeth into the fitting grooves.

In accordance with (5) of the present invention, in a receptacle connector according to any one of (1) through (4), the first holding mechanism includes the ball removably disposed in the hole defined in the thicker portion of the holder, for being fitted into the hole defined in the plug to connect the plug to the holder, and the recess defined in the outer circumferential surface of the first body for receiving the ball retracted therein while the ball is disposed in the hole of the holder which slides against the helical spring.

Advantages of the Invention

According to the present invention, there is provided a receptacle connector which allows a plug to be easily connected thereto and removed therefrom, and which securely prevents the plug from being dislodged from the receptacle connector.

MODE FOR CARRYING OUT THE INVENTION

Figure 1:
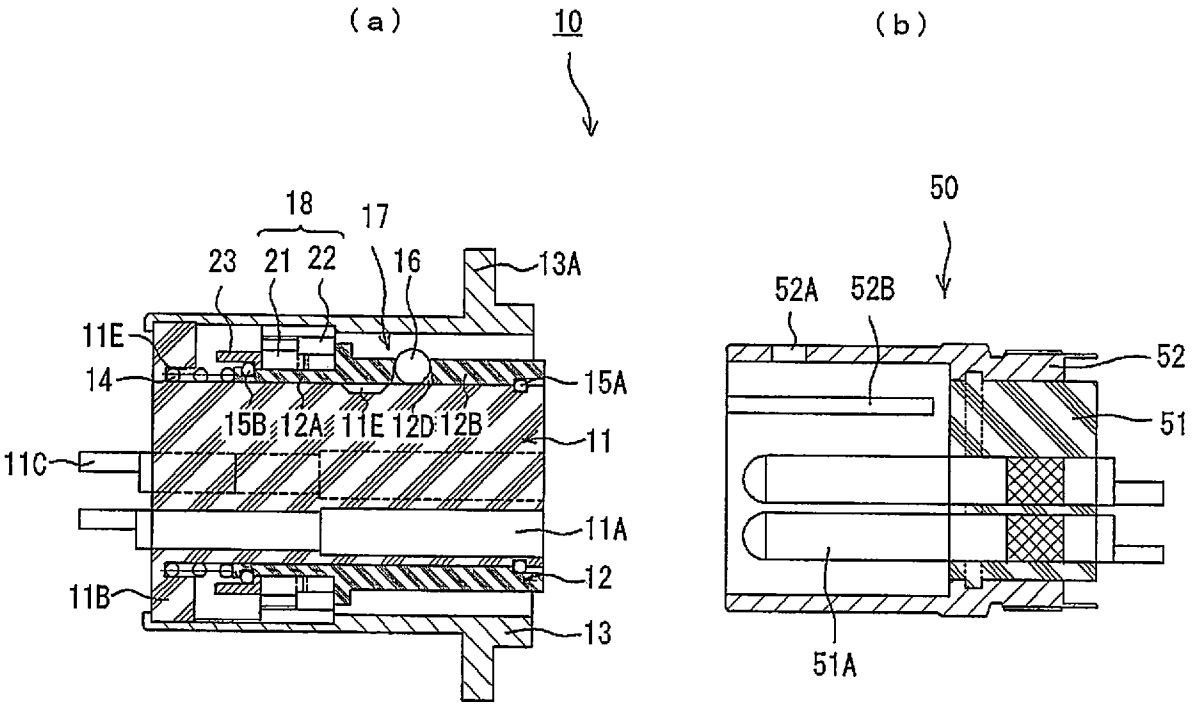
FIG. 1 is an axial cross-sectional view of a receptacle connector according to an embodiment of the present invention and a plug.

A receptacle connector according to an embodiment of the present invention shown in FIGS. 1 through 8(*a*), 8(*b*) will be described below. As shown in FIG. 1, the receptacle connector, denoted by 10, according to the embodiment is used to connect communication cables for audio and video signals through a plug 50, and allows the plug 50 to be easily connected and removed as described later.

The receptacle connector 10 according to the present embodiment and the plug 50 will be described below. As shown in FIG. 1, the receptacle connector 10 includes a first body 11 having a plurality of (e.g., three) pin holes 11A for electrical connection to pins of the plug 50, a tubular holder 12 having a thinner portion 12A on a proximal end side thereof (left side in FIG. 1) and a thicker portion 12B on a distal end side thereof (right side in FIG. 1) with a step interposed therebetween, the tubular holder 12 being slidable along the first body 11, a tubular first shell 13 having an end fixed to a flange 11B on the proximal end of the first body 11 and the other end extending to the distal end of the holder 12, a helical spring 14 resiliently disposed between the large-diameter portion (flange) 11B of the first body 11 and the proximal end of the holder 12, and a stop ring 15A for preventing the holder 12 biased by the helical spring 14 from being dislodged from the first body 11. The first shell 13 has a flange 13A on a distal end portion thereof. The receptacle connector 10 is fixed to a panel (not shown) by the flange 13A.

Figure 2:
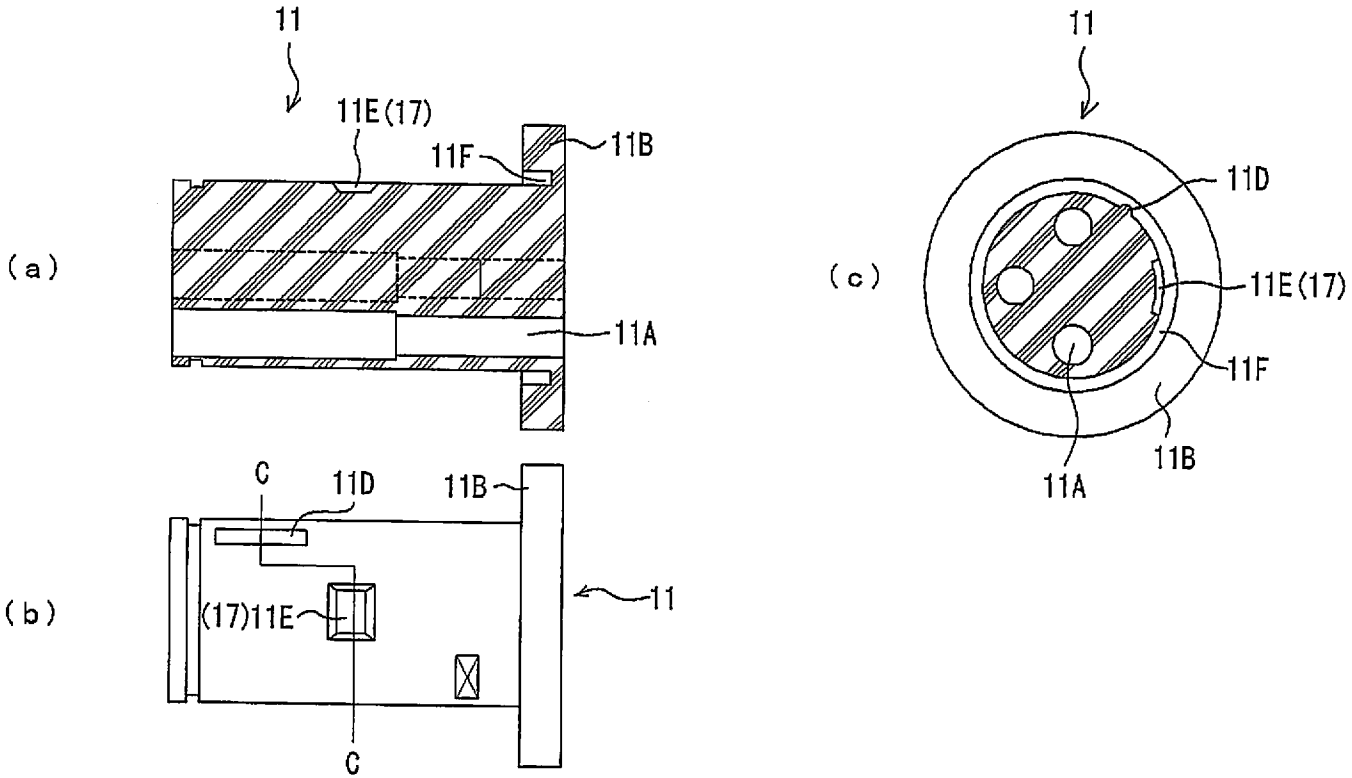
FIGS. 2(*a*) through 2(*c*) are views of a first body of the receptacle connector shown in FIG. 1, FIG. 2(*a*) being a cross-sectional view taken along the axis thereof, FIG. 2(*b*) a side elevational view of a central portion thereof, and FIG. 2(*c*) a cross-sectional view taken along line C-C of FIG. 2(*b*)

As shown in FIGS. 2(*a*) and 2(*c*), the first body 11 is in the form of a cylinder of synthetic resin. As shown in FIG. 2(*a*), the three pin holes 11A extend axially through the first body 11 and are spaced from each other. As shown in FIG. 2(*c*), the three pin holes 11A jointly make up a triangular shape at a distal end surface. Sheath-like conductor terminals are mounted on the inner circumferential surfaces of the pin holes 11A, and connection pins 11C (see FIG. 1) for connection to cables (not shown) extend from the conductor terminals. As shown in FIG. 1 at (a), the first body 11 is covered by the holder 12, which is slidable on the outer circumferential surface of the first body 11.

Figure 3:
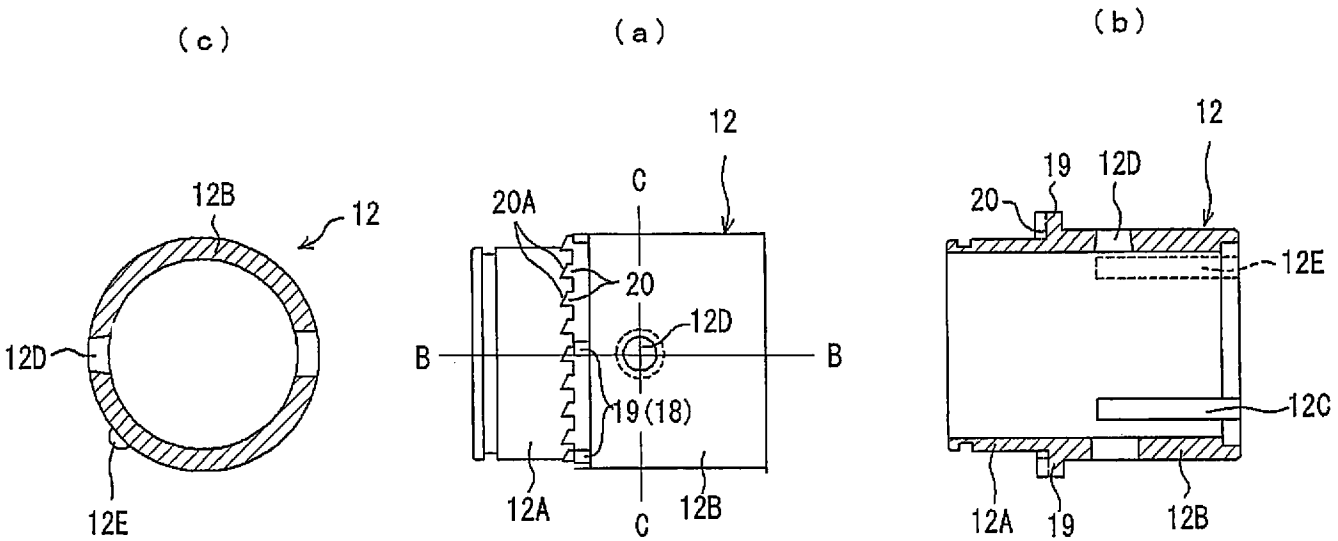
FIGS. 3(*a*) through 3(*c*) are view of a holder of the receptacle connector shown in FIG. 1, FIG. 3(*a*) being a side elevational view of a central portion thereof, FIG. 3(*b*) a cross-sectional view taken along line B-B of FIG. 3(*a*), and FIG. 3(*c*) a cross-sectional view taken along line C-C of FIG. 3(*a*)

As shown in FIGS. 2(*b*) and 2(*c*), the first body 11 has a ridge 11D extending axially on a distal end portion of the circumferential surface thereof. The holder 12 has a groove 12C defined in the inner circumferential surface thereof and extending axially from the distal end to an intermediate position, as shown in FIG. 3(*b*), in alignment with the ridge 11D. With the ridge 11D engaging in the groove 12C, the holder 12 which is mounted on the first body 11 is resiliently biased to move straight by the helical spring 14. The ridge 11D and the groove 12C also perform a positioning function at the time the holder 12 is mounted on the first body 11.

As shown in FIGS. 1 and 3, the thicker portion 12B of the holder 12 has a hole 12D defined therein. As shown in FIG. 1, a ball 16 for connecting the plug 50 is disposed in the hole 12D. As shown in FIG. 3, the hole 12D is gradually tapered off from the inner circumferential surface toward outer circumferential surface of the holder 12. As shown in FIG. 1, when the holder 12 is in an initial state, the ball 16 is held in contact with the outer circumferential surface of the first body 11 and partly projects from the hole 12D in the holder 12. The ball 16 fits into a recess 11E defined in the circumferential surface of the first body 11 and, while in the hole 12D, is retracted from the circumferential surface of the holder 12. The recess 11E is spaced from the hole 12D toward the proximal end when the holder 12 is in the initial state. When the holder 12 is pushed in toward the proximal end against the bias of the helical spring 14, the ball 16 is retracted from the hole 12D into the recess 11E.

As shown in FIG. 1, the helical spring 14 has an end fitted in and supported by an annular groove 11F (see FIG. 2(*a*)) defined in the flange 11B of the first body 11 and the other end supported by the distal end of the holder 12.

As shown in FIG. 1, the plug 50 includes a second body 52 having a plurality of (three in the present embodiment) pins 51A corresponding respectively to the pin holes 11A in the first body 11, and a second shell 52 extending from a proximal end portion (right side in FIG. 1 at (b)) of the circumferential surface of the second body 51 to a position slightly ahead of the distal ends of the three pins 51A. The second shell 52 has an inside diameter slightly greater than the holder 12 and an outside diameter slightly smaller than the inside diameter of the first shell 13. When the plug 50 is connected, it is inserted into the clearance between the holder 12 and the first shell 13, with the pins 51A inserted in the pin holes 11A. The second shell 52 has a hole 52A defined therein near the distal end thereof for receiving an upper portion of the ball 16 fitted therein. The ball 16 which projects from the circumferential surface of the holder 12 is fitted into the hole 52A, thereby connecting the plug 50 to the receptacle connector 10. As shown in FIG. 1 at (a) and (b), the second shell 52 has a groove 52B defined in the inner circumferential surface thereof and extending from the distal end toward the proximal end thereof. As shown in FIG. 3(*c*), the holder 12 has a ridge 12E disposed on the outer circumferential surface thereof and held in alignment with the groove 52B. When the plug 50 is connected to the receptacle connector 10, the groove 52B and the ridge 12E serve to position them.

The receptacle connector 10 has first and second holding mechanisms 17, 18 that function when the plug 50 is connected. Only by pushing the second shell 52 into the clearance between the holder 12 and the first shell 13, the first and second holding mechanisms 17, 18 function to simply connect the plug 50 to the receptacle connector 10. The plug 50 can also be pulled out of the receptacle connector 10 only by pushing in the plug 50. The first and second holding mechanisms 17, 18 will be described below.

As shown in FIGS. 1 through 3, the first holding mechanism 17 includes the ball 16 which is movably disposed in the hole 12D defined in the thicker portion 12B of the holder 12 and fitted in the hole 52A defined in the plug 50, and the recess 11E defined in the outer circumferential surface of the first body 11 for receiving the ball 16 in the hole 12D defined in the holder 12 that slides against the helical spring 14. When the plug 50 is pushed into the holder 12 against the bias of the helical spring 14, the ball 16 in the hole 12D in the holder 12 is retracted into the recess 11E defined in the first body 11. Thereafter, when the holder 12 is pushed back under the bias of the helical spring 14, the ball 16 moves out of the recess 12D and projects into the hole 52A in the plug 50, connecting the plug 50 to the holder 12, i.e., the receptacle connector 10, and keep them connected. For removing the plug 50, the plug 50 is pushed in, causing the holder 12 to slide against the bias of the helical spring 14. The ball 16 is retracted into the recess 11E, disconnecting the plug 50 and allowing the plug 50 to be removed.

The second holding mechanism 18 functions to keep the plug 50 connectable or removable when the plug 50 is inserted into the clearance between the holder 12 and the first shell 13 to connect the plug 50 to the receptacle connector 10. Specifically, as shown in FIGS. 1 through 6, the second holding mechanism 18 includes a plurality of (six in the present embodiment) radially outward fingers 19 (see FIGS. 3 and 4) radially outwardly projecting from the end face of the step of the thicker portion 12B of the holder 12 and circumferentially spaced at equal intervals, a plurality of (twenty four in the present embodiment) first engaging teeth 20 (see FIG. 3) circumferentially spaced at equal intervals and projecting from the step of the thicker portion 12B of the holder 12 toward the proximal end, the first engaging teeth 20 being circumferentially slightly displaced from the radially outward fingers 19 by a certain angle, a first ring 21 (see FIGS. 1 and 5) rotatably disposed between the flange 11B of the first body 11 and the first engaging teeth 20 of the holder 12 and having a plurality of (twelve in the present embodiment) second engaging teeth 21A for engaging respective circumferentially slanted surfaces 20A of the first engaging teeth 20, and a ring-shaped bushing 22 (see FIGS. 1 and 6) fixedly disposed on the inner circumferential surface of the first shell 13 between the first and second engaging teeth 20, 21A and having a plurality of (twelve in the present embodiment) third engaging teeth 22A for engaging respective circumferentially slanted surfaces 21B of the second engaging teeth 21A to rotate the first ring 21 circumferentially.

A second ring 23 adjacent to the first ring 21 is axially slidably mounted on the proximal end of the holder 12. Under the bias of the helical spring 14, the second ring 23 together with the holder 12 moves the first body 11, holding the first ring 21 resiliently against the bushing 22.

The relationship between the holder 12, the first ring 21, and the bushing 22 in the first holding mechanism 18 will further be described below with reference to FIGS. 1 through 8. As shown in FIG. 1, the radially outward fingers 19 of the thicker portion 12B of the holder 12 are spaced from the bushing 22 toward the distal end, with the bushing 22 being disposed between the first engaging teeth 20 of the holder 12 and the second engaging teeth 21A of the first ring 21.

Figure 4:
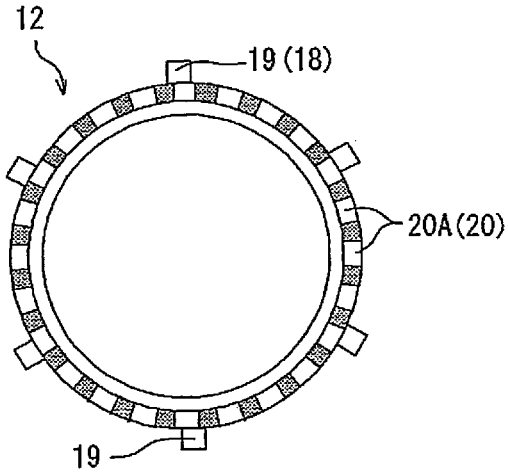
FIGS. 4(*a*) and 4(*b*) are views of the holder shown in FIGS. 3(*a*) through 3(*c*), FIG. 4(*a*) being a front elevational view of a left end of the holder shown in FIG. 3(*a*), and FIG. 4(*b*) an enlarged fragmentary view of the holder shown in FIG. 4(*a*)
Figure 4:
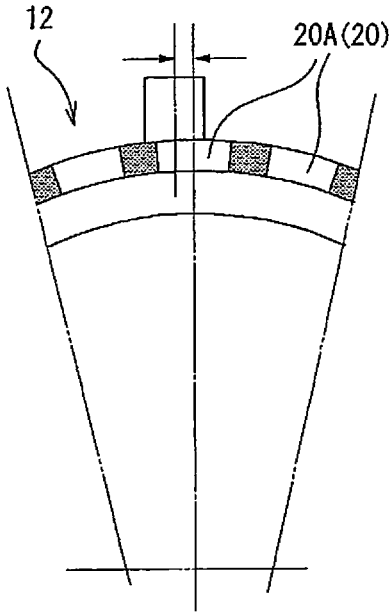
Figure 6:
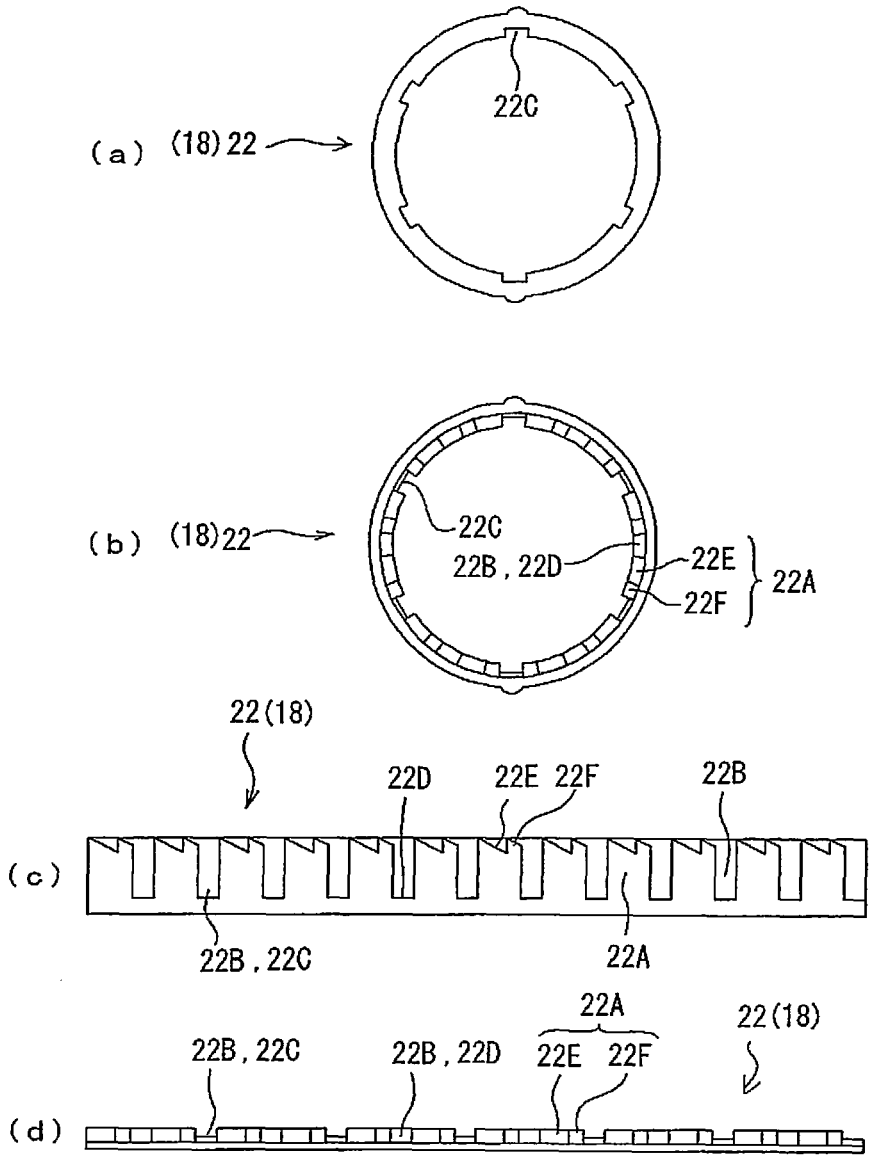
FIGS. 6(*a*) through 6(*d*) are views of a bushing of the receptacle connector shown in FIG. 1, FIG. 6(*a*) being a front elevational view of a front end side of the receptacle connector, FIG. 6(*b*) a front elevational view of an opposite side of the receptacle connector, FIG. 6(*c*) a developed view of a side surface of the receptacle connector, and FIG. 6(*d*) a developed view of the opposite side shown in FIG. 6(*b*)

As shown in FIG. 4(*a*), the six radially outward fingers 19 are spaced at equal intervals in the circumferential directions of the holder 12 (at intervals of 60° in the circumferential directions). As shown in FIG. 4(*a*), the twenty-four first engaging teeth 20 are spaced at equal intervals in the circumferential directions (at intervals of 15°). As shown in FIG. 4(*b*), each of the radially outward fingers 19 is positionally displaced circumferentially a slight angle from one of the first engaging teeth 20. The six radially outward fingers 19 jointly define an outside diameter smaller than the outside diameter of the bushing 22. As shown in FIGS. 6(*a*) and 6(*b*), gaps 22B between the third engaging teeth 22A include cavities 22C circumferentially spaced at intervals of 60°, and the radially outward fingers 19 pass centrally through the cavities 22C. Each of the gaps is wider than the circumferential width of the first engaging teeth 20. The twenty-four first engaging teeth 20 jointly define an outside diameter slightly smaller than the inside diameter of the third engaging teeth 22A. The slanted surfaces 20A which are slanted downwardly circumferentially are provided on the projecting end faces of the first engaging teeth 20, as shown in FIG. 3(*b*).

Figure 5:
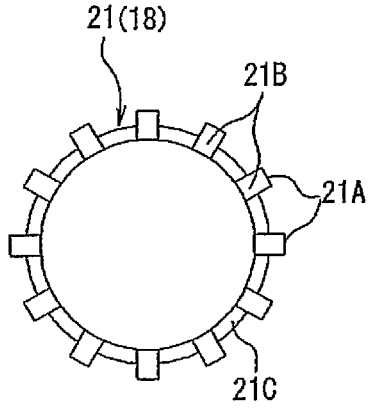
FIGS. 5(*a*) through 5(*c*) are views of a first ring of the receptacle connector shown in FIG. 1, FIG. 5(*a*) being a side elevational view thereof, FIG. 5(*b*) a front elevational view of a lower end of the first ring shown in FIG. 5(*a*), and FIG. 5(*c*) a front elevational view of an upper end of the first ring shown in FIG. 5(*a*)
Figure 5:
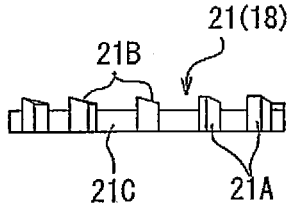
Figure 5:
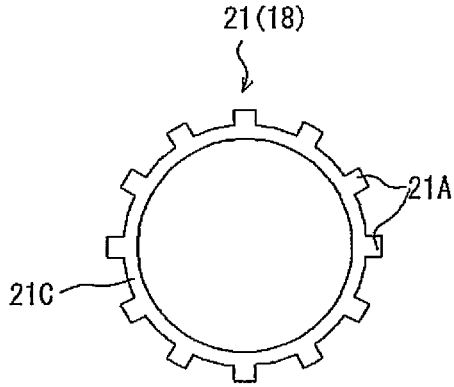

As shown in FIGS. 5(*a*) through 5(*c*), the twelve second engaging teeth 21A of the first ring 21 are circumferentially spaced at equal intervals (intervals of) 30°) on a ring body 21C. As shown in FIGS. 5(*a*) through 5(*c*), the second engaging teeth 21A project from both the outer circumferential surface and one surface (upper surface in FIG. 5(*b*)) of the ring body 21C. As shown in FIGS. 5(*a*) and 5(*c*), the second engaging teeth 21A project radially outwardly from the ring body 21C as viewed in plane. The second engaging teeth 21A have a circumferential width greater than the radially outward fingers 19, and are of substantially the same dimension as the gaps 22B between the adjacent ones of the third engaging teeth 22A of the bushing 22, so that the second engaging teeth 21A are fitted in the gaps 22B. Half of the twelve gaps 22B have the cavities 22C, and the remaining half of the twelve gaps 22B have bottom surfaces 22D on the distal end. Specifically, as shown in FIGS. 6(*b*) and 6(*d*), the bushing 22 has the cavities 22C and the bottom surfaces 22D arranged alternately circumferentially.

The twelve second engaging teeth 21A jointly define an outside diameter that is substantially the same as the outside diameter jointly defined by the twelve third engaging teeth 22A. Each of the second engaging teeth 21A has a radial width greater than the radial width of the third engaging teeth 22A.

In the state shown in FIG. 1, therefore, since the holder 12 is normally biased toward the distal end by the helical spring 14, the first ring 21 is pressed by the second ring 23 to cause the second engaging teeth 21A to be fitted into the gaps 22B of the bushing 22 and resiliently held against the bottom surfaces 22D, holding the first engaging teeth 20 in a position spaced from the bushing 22 toward the distal end. The gaps 22B of the bushing 22 are thus defined as fitting grooves 22B.

The second and third engaging teeth 21A, 22A have slanted surfaces 21B, 22E provided on respective projecting end faces and slanted downwardly circumferentially. The second engaging teeth 21A and the third engaging teeth 22A engage each other with their slanted surfaces 21B, 22E. The slanted surfaces 21B of the second engaging teeth 21A are contacted by the slanted surfaces 20A of the first engaging teeth 20 of the holder 12 inwardly of the radially outward fingers 19. The circumferential length of the slanted surfaces 22E of the third engaging teeth 22A is greater than the circumferential length of the slanted surfaces 21B of the second engaging teeth 21A. Under the bias of the helical spring 14, the slanted surfaces 21B are pushed by the slanted surfaces 22E to slide, causing the first ring 21 to rotate in the slanted direction.

As shown in FIG. 6(*b*), the slanted surfaces 22E of the third engaging teeth 22A have engaging portions on their extension ends for stopping the second engaging teeth 21A against sliding movement. The engaging portions have on their projecting end faces slanted surfaces 22F that are slanted at substantially the same angle as the slanted surfaces 22E. The slanted surfaces 22F are shorter than the slanted surfaces 22E. The slanted surfaces 22E and the slanted surfaces 22F have respective upper ends at the same height. The slanted surfaces 22F have a function to guide the second engaging teeth 21A into the fitting grooves 22B.

Figure 7:
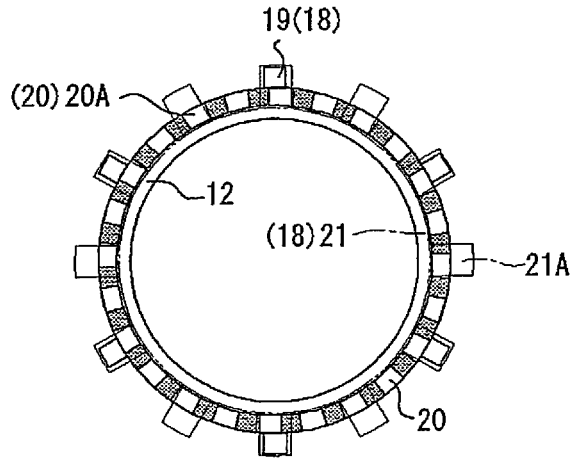
FIGS. 7(*a*) and 7(*b*) are views illustrative of the relationship between the holder shown in FIGS. 3(*a*) through 3(*c*) and the first ring shown in FIGS. 5(*a*) through 5(*c*)
Figure 7:
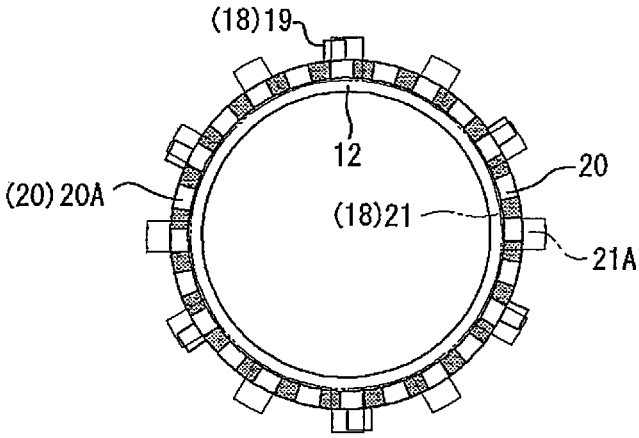

Operation to install the plug 50 on the receptacle connector 10 and remove the plug 50 from the receptacle connector 10 will be described below also with reference to FIGS. 7 and 8.

With the receptacle connector 10 fixed to the panel (not shown), the ball 16 projects from the hole 12D in the holder 12, as shown in FIG. 1, and the radially outward fingers 19 are spaced from the bushing 22 toward the distal end. Under the bias of the helical spring 14, the first ring 21 is resiliently held against the bushing 22 by the second ring 23. At this time, the second engaging teeth 21A of the first ring 21 are resiliently held against the bottom surfaces 22D of the fitting grooves 22B in the bushing 22, and are disposed in the fitting grooves 22B.

For connecting the plug 50 to the receptacle connector 10 shown in FIG. 1, the groove 52B in the second shell 52 is aligned with the ridge 12E on the holder 12, and the second shell 52 is inserted into the clearance between the holder 12 and the first shell 13. The distal end of the second shell 52 hits the ball 16 projecting from the holder 12, after which the bias of the helical spring 14 acts on the plug 50. When the plug 50 is inserted against the bias of the helical spring 14, the holder 12 slides the first body 11, and the radially outward fingers 19 of the holder 12 move into the cavities 22C of the bushing 22.

At this time, since the second engaging teeth 21A of the first ring 21 are positioned in the cavities 22C (the cavities 22C are also the fitting grooves 22B), the first engaging teeth 20 and the second engaging teeth 21A contact each other through the respective slanted surfaces 20A, 21B thereof, the first ring 21 moves toward the proximal end, then the radially outward fingers 19 move into the cavities 22C. At the time the radially outward fingers 19 move into the cavities 22C, the radially outward fingers 19 and the second engaging teeth 21A have their central lines across the circumferential widths thereof held in alignment with each other, as shown in FIG. 7(*a*), with the first engaging teeth 20 being displaced to and held against the right sides of the second engaging teeth 21A. They remain in the state shown in FIG. 7(*a*) until the radially outward fingers 19 reach the upper ends of the slanted surfaces 22E of the third engaging teeth 22A of the bushing 22.

Figure 8:
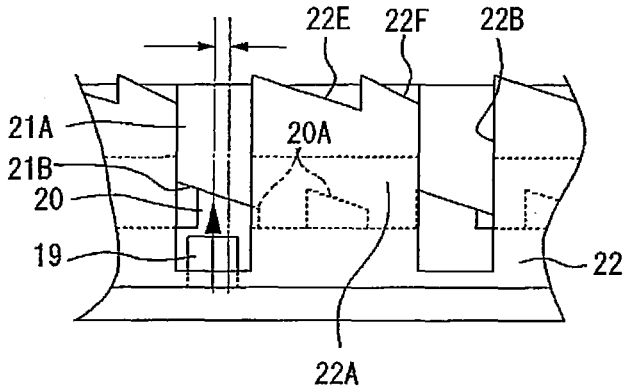
FIGS. 8(*a*) and 8(*b*) are views illustrative of the relationship between the holder, the first ring, and the bushing.
Figure 8:
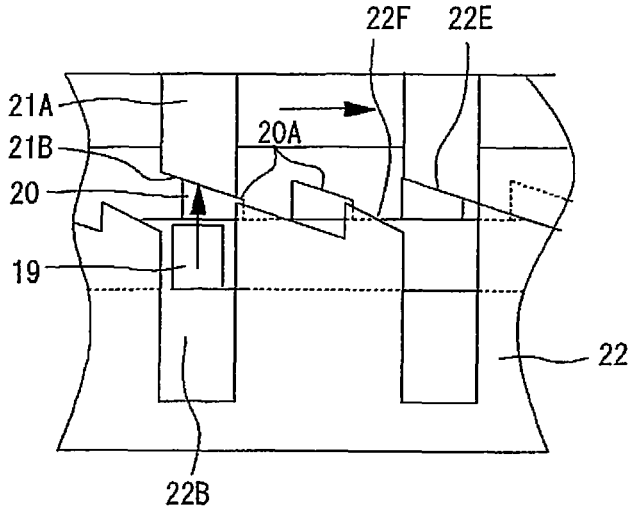
Figure 9:
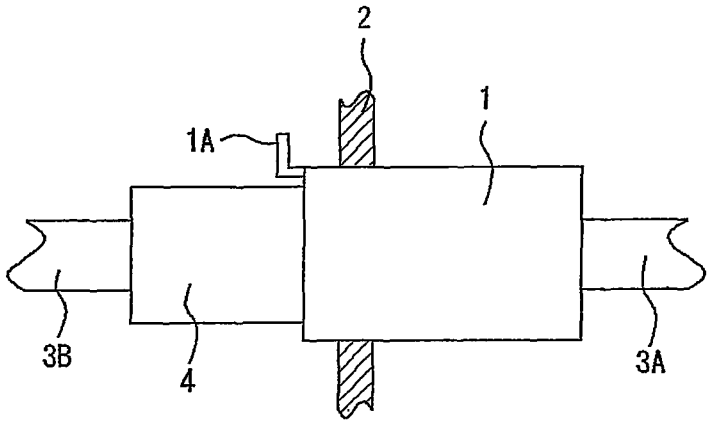
Fig. 9 PRIOR ART
FIG. 9 is a side elevational view of a receptacle connector according to the background art and a plug which are connected to each other.

When the upper ends of the radially outward fingers 19 reach the upper ends of the slanted surfaces 22E of the third engaging teeth 22A, as shown in FIG. 8(*b*), the second engaging teeth 21A are not constrained by the fitting grooves 22B. As the second engaging teeth 21A are resiliently pressed against the first engaging teeth 20 by the helical spring 14, the first ring 21 is turned clockwise in FIG. 7(*a*) or to the right in FIG. 8(*b*) along the slanted surfaces 20A of the first ring 21 onto the slanted surfaces 22E of the third engaging teeth 22A. Since the slanted surfaces 21B of the second engaging teeth 21A are shorter than the slanted surfaces 22E of the third engaging teeth 22A, the first ring 21 slides on the slanted surfaces 22E under the action of the helical spring 14, and turns up to the engaging portions where it stops. At this time, the ball 16 of the holder 12 is retracted into the recess 11E, the second shell 52 of the plug 50 moves beyond the hole 12D of the holder 12 into contact with the radially outward fingers 19 of the holder 12, and the hole 52A of the second shell 52 reaches a position immediately above the ball 16.

After the first ring 21 is stopped against turning movement by the engaging portions, when the plug 50 is pushed in against the bias of the helical spring 14, the first ring 21 moves toward the proximal end while in contact with the first engaging teeth 20. The slanted surfaces 21B of the second engaging teeth 21A disengage from the engaging portions, and the first ring 21 turns in the direction described above. The second engaging teeth 21A are guided by the slanted surfaces 22F of the engaging portions to reach the fitting grooves 22B. The second engaging teeth 21A are fitted into the fitting grooves 22B and move toward the distal end until they reach the bottom surfaces 22D. At this time, the holder 12 is also moved toward the distal end by the helical spring 14, during which time the ball 16 returns from the recess 11E into the hole 12D and projects into the hole 52A of the first shell 52 of the plug 50, whereupon the plug 50 is connected to the holder 12, i.e., the receptacle connector 10.

For removing the plug 50 from the receptacle connector 10, the plug 50 is pushed into the receptacle connector 10. As described above, the instant the second engaging teeth 21A of the first ring 21 come out of the fitting grooves 22B of the bushing 22, they turn and stop on the slanted surfaces 22E of the third engaging teeth 22A of the bushing 22. At this time, the ball 16 is retracted from the second shell 52A of the plug 50 and enters the recess 11E of the first body 11. The plug 50 is then pushed in again. When second engaging teeth 21A are guided by the slanted surfaces 22F of the engaging portions and fitted into the fitting grooves 22B, the ball 16 is positioned in the recess 11E and displaced out of engagement with the second shell 52A. Therefore, the plug 50 can simply be pulled out of the holder 12.

According to the present embodiment, as described above, the receptacle connector 10 includes the first holding mechanism 17 for holding the plug 50 connected to the holder 12 by fitting the ball 16 disposed in the hole 12D defined in the holder 12 into the hole 52A defined in the second shell 52 of the plug 50 through the recess 11E defined in the outer circumferential surface of the first body 11, and the second holding mechanism 18 for coacting with the first holding mechanism 17 to keep the plug 50 and the holder connectable to and releasable from each other. Therefore, the user can simply connect the plug 50 to the receptacle connector 10 and remove the plug 50 from the receptacle connector 10, and reliably prevent the plug from being pulled out of the receptacle connector, simply by pushing the plug 50 into the holder 12 of the receptacle connector 10 with one hand, without performing a complex process of operating a lever with one hand and installing and removing the plug with the other hand as is the case with the receptacle connector according to the background art.

The present invention is not limited to the above embodiment, but various components may be changed in design if necessary.

DESCRIPTION OF REFERENCE CHARACTERS

10 receptacle connector
11 first body
11A pin hole
11E recess
12 holder
12A thinner portion
12B thicker portion
12D hole
13 first shell
14 helical spring
16 ball
17 first holding mechanism
18 second holding mechanism
19 radially outward finger
20 first engaging tooth
20A slanted surface
21 first ring
21A second engaging tooth
21B slanted surface
22 bushing
22A third engaging tooth
22B fitting groove
22C cavity
22E slanted surface
22F slanted surface
23 second ring
50 plug
51 pin
52 second shell
52A hole

The invention claimed is:

1. A receptacle connector comprising:

a first body having a pin hole for inserting therein a pin of a plug for electrical connection thereto;

a tubular holder having a thinner portion disposed on a proximal end side thereof and a thicker portion disposed on a distal end side portion thereof with a step interposed therebetween, said tubular holder being slidable along said first body;

a tubular first shell having an end fixed to a large-diameter portion on a proximal end of said first body and another end extending to a distal end of the holder;

a helical spring resiliently disposed between said large-diameter portion on the proximal end of the first body and a proximal end of the holder;

a stop ring for preventing the holder biased by said helical spring from being dislodged from said first body;

a first holding mechanism for holding the plug connected to the holder by fitting a ball disposed in a hole defined in the holder into a hole defined in a second shell of the plug through a recess defined in an outer circumferential surface of the first body; and a second holding mechanism for coacting with the first holding mechanism to keep the plug and the holder connectable to and releasable from each other;

wherein when the plug is pushed in between the holder and the first shell against the bias of the helical spring, the first holding mechanism is actuated to fix the plug to the holder and the second holding mechanism holds the plug and the holder connected to each other;

when the plug is pushed in against the bias of the helical spring while the plug and the holder are connected to each other, the second holding mechanism releases the plug and the holder from each other and the first holding mechanism is actuated to release the plug and the holder from each other;

the second holding mechanism comprising:

a plurality of radially outward fingers projecting radially outwardly from a circumferential surface of the thicker portion side of said step of the holder and circumferentially spaced at equal intervals;

a plurality of first engaging teeth projecting from an end face of the step of the thicker portion of the holder toward the proximal end side and circumferentially spaced at equal intervals, the first engaging teeth being circumferentially displaced from the radially outward fingers by a predetermined angle;

a first ring rotatably disposed between the large-diameter portion on the proximal end of the first body and the first engaging teeth of the holder and having a plurality of second engaging teeth engaging circumferentially slanted surfaces of the first engaging teeth; and a bushing positioned on an inner circumferential surface of the first shell between the first and second engaging teeth and having third engaging teeth for engaging circumferentially slanted surfaces of the second engaging teeth to rotate the first ring circumferentially;

wherein said bushing has a plurality of cavities defined in an inner circumferential surface thereof for passing therein the radially outward fingers and fitting grooves defined in the inner circumferential surface thereof for allowing the second engaging teeth to move into and out of the fitting grooves.

2. A receptacle connector according to claim 1, wherein the third engaging teeth of the bushing has slanted surfaces circumferentially longer than the slanted surfaces of the second engaging teeth of the first ring, and engaging portions disposed on respective extension ends of the slanted surfaces for stopping the first ring against rotation.

3. A receptacle connector according to claim 1, wherein the first engaging teeth have a width representing the sum of widths of at least the radially outward fingers and the second engaging teeth disposed inwardly of the radially outward fingers.

4. A receptacle connector according to claim 2, wherein the engaging portions of the third engaging teeth have, on projecting ends thereof, slanted surfaces for guiding the second engaging teeth into the fitting grooves.

5. A receptacle connector according to claim 1, wherein the first holding mechanism includes the ball removably disposed in the hole defined in the thicker portion of the holder, for being fitted into the hole defined in the plug to connect the plug to the holder, and the recess defined in the outer circumferential surface of the first body for receiving the ball retracted therein while the ball is disposed in the hole of the holder which slides against the helical spring.

* * * * *